US009230790B2

(12) United States Patent
Loboda

(10) Patent No.: US 9,230,790 B2
(45) Date of Patent: Jan. 5, 2016

(54) DC ION FUNNELS

(71) Applicant: DH Technologies Development Pte. Ltd., Singapore (SG)

(72) Inventor: Alexandre V. Loboda, Thornhill, CA (US)

(73) Assignee: DH TECHNOLOGIES DEVELOPMENT PTE. LTD., Singapore (SG)

( * ) Notice: Subject to any disclaimer, the term of this patent is extended or adjusted under 35 U.S.C. 154(b) by 0 days.

(21) Appl. No.: 14/369,932

(22) PCT Filed: Nov. 28, 2012

(86) PCT No.: PCT/IB2012/002519

§ 371 (c)(1),
(2) Date: Jun. 30, 2014

(87) PCT Pub. No.: WO2013/098598

PCT Pub. Date: Jul. 4, 2013

(65) Prior Publication Data

US 2014/0339414 A1 Nov. 20, 2014

Related U.S. Application Data

(60) Provisional application No. 61/581,965, filed on Dec. 30, 2011.

(51) Int. Cl.
*H01J 49/06* (2006.01)
*H01J 49/26* (2006.01)

(52) U.S. Cl.
CPC ..... *H01J 49/066* (2013.01); *H01J 49/26* (2013.01)

(58) Field of Classification Search
USPC ..... 250/281, 283, 396 R, 288, 287
See application file for complete search history.

(56) References Cited

U.S. PATENT DOCUMENTS

| | | | | |
|---|---|---|---|---|
| 6,762,404 | B2 * | 7/2004 | Bateman et al. | 250/281 |
| 2004/0026612 | A1 | 2/2004 | Bateman | |
| 2004/0031920 | A1 * | 2/2004 | Giles et al. | 250/287 |
| 2010/0038533 | A1 * | 2/2010 | Makarov et al. | 250/288 |
| 2011/0186732 | A1 * | 8/2011 | Yasuno | 250/288 |
| 2011/0233397 | A1 * | 9/2011 | Barofsky et al. | 250/294 |

FOREIGN PATENT DOCUMENTS

| | | |
|---|---|---|
| WO | 2005104182 | 11/2005 |
| WO | 2008055668 | 5/2008 |

OTHER PUBLICATIONS

International Search Report for International Patent Application No. PCT/IB2012/002519, dated Mar. 29, 2013.

* cited by examiner

*Primary Examiner* — Phillip A Johnston
*Assistant Examiner* — Hsien Tsai

(57) ABSTRACT

Systems and related methods are disclosed herein that generally involve focusing dispersed ions using one or more DC ion funnels. In some embodiments, a DC ion funnel is provided that includes a plurality of ring-shaped electrodes, each having an aperture formed therein such that the funnel defines an interior volume extending between an ion inlet and an ion outlet. A controller applies a DC potential to each of the electrodes without applying an RF potential to any of the electrodes, such that ions entering the funnel are substantially confined within said volume. The interior volume can have any of a variety of shapes, such as cylindrical, frusto-conical, and curved frusto-conical. In addition, any of a variety of DC potentials can be applied to the plurality of electrodes.

7 Claims, 9 Drawing Sheets

800

800

DC ION FUNNELS

RELATED APPLICATION

This application claims the benefit and priority of U.S. Provisional Application Ser. No. 61/581,965, filed on Dec. 30, 2011, the entire contents of which is incorporated herein by reference.

FIELD

The applicant's teachings relate to systems and methods for focusing dispersed ions entrained in a flow of a carrier gas. More particularly, the applicant's teachings relate to direct current (DC) ion funnels and corresponding methods for use in mass spectrometry.

BACKGROUND

A typical mass spectrometer includes an ion source module, an analyzer module, and a detector module. Typically, in the ion source module, a sample that is to be analyzed is converted to an ion beam comprising a plurality of charged particles dispersed in a carrier gas. The analyzer module separates the charged particles according to their mass using electromagnetic fields. The detector module then measures or calculates the abundance of various types of ions to provide information for determining the composition of the sample.

Usually, the ion source module operates at or near atmospheric pressure (e.g., in the case of atmospheric-pressure ionization (API) and atmospheric-pressure chemical ionization (APCI) ion sources). The analyzer module, however, usually requires high vacuum conditions to operate effectively. To transport ions that are generated at atmospheric pressure and contained within a carrier gas into a vacuum region, an orifice plate typically is used that defines a sampling orifice through which the ions are able to pass. The sampling orifice is generally quite small (e.g., 1 mm in diameter) to enable maintenance of a high pressure differential across the orifice plate. In addition, the analyzer module can include several stages of differential pumping to create large pressure differences, in which case each of a plurality of pressure regions are connected in series through apertures in order to allow gas flow from one pressure region to the next. Due to the limited size of the sampling orifice and the apertures between each pressure region, a significant portion of the dispersed ions fail to pass through such openings. As a result, many ions of interest are lost, and the overall sensitivity of the system is reduced.

A number of systems have been proposed to focus an ion beam towards an opening so as to increase the proportion of ions that pass through the opening and thereby improve system sensitivity. For example, a radio frequency (RF) ion funnel has been proposed that includes a plurality of axially-aligned ring-shaped electrodes mounted in proximity to an opening through which the ion beam is to be directed. Each electrode has an inner diameter that is less than that of the immediately-preceding electrode, such that ions travelling in the axial direction towards the opening encounter electrodes having progressively-smaller inner diameters. RF potentials are applied to each of the electrodes, and the phase of the RF potential is varied from one electrode to the next. Ions travelling towards the periphery of the RF ion funnel are repelled by the field existing near the surface of the electrodes, and are thereby urged towards, and substantially confined to, the essentially field-free center region of the RF ion funnel.

Meanwhile, much of the carrier gas is permitted to escape the RF ion funnel through spaces between adjacent electrodes.

While RF ion funnels have shown some promise, they suffer from a number of shortcomings. Most notably, the ability of such systems to effectively confine ions deteriorates rapidly as operating pressure increases. Thus, if the sampling orifice or apertures between pressure regions are increased in size to allow more ions to pass, the operating pressure quickly reaches a point at which the RF ion funnel becomes ineffective. In addition, RF ion funnels require a large amount of RF power to operate, especially when higher RF frequencies are used to allow the system to operate at higher pressures.

Accordingly, a need exists for improved systems and methods for focusing dispersed ions.

Further introductory information can be found in the following references, the entire content of each of which is incorporated herein by reference:

U.S. Pat. No. 6,107,628 to Smith et al., entitled "METHOD AND APPARATUS FOR DIRECTING IONS AND OTHER CHARGED PARTICLES GENERATED AT NEAR ATMOSPHERIC PRESSURES INTO A REGION UNDER VACUUM";

U.S. Pat. No. 6,639,213 to Gillig et al., entitled "PERIODIC FIELD FOCUSING ION MOBILITY SPECTROMETER";

U.S. Pat. No. 7,223,969 to Schultz et al., entitled "ION MOBILITY TOF/MALDI/MS USING DRIFT CELL ALTERNATING HIGH AND LOW ELECTRICAL FIELD REGIONS";

U.S. Pat. No. 7,259,371 to Collings et al., entitled "METHOD AND APPARATUS FOR IMPROVED SENSITIVITY IN A MASS SPECTROMETER";

U.S. Pat. No. 7,365,319 to Hager et al., entitled "METHOD FOR PROVIDING BARRIER FIELDS AT THE ENTRANCE AND EXIT END OF A MASS SPECTROMETER";

U.S. Patent Publication No. 2010/0038532 to Makarov et al., entitled "EFFICIENT ATMOSPHERIC PRESSURE INTERFACE FOR MASS SPECTROMETERS AND METHOD";

GERLICH, "Inhomogeneous RF Fields: A Versatile Tool for the Study of Processes with Slow Ions," Advances in Chemical Physics Series, Vol. LXXXII (1992);

GUAN et al., "Stacked-Ring Electrostatic Ion Guide," Journal of American Society for Mass Spectrometry 1996, 7, 101-106; and KREMER et al., "A Novel Method for the Collimation of Ions at Atmospheric Pressure," Journal of Physics D: Applied Physics 39 (2006) 5008-5015.

SUMMARY

In one aspect of at least one embodiment of the applicant's teachings, an apparatus for focusing dispersed ions is provided that can comprise a plurality of electrodes spaced apart from one another, each of said electrodes having an aperture for passage of ions therethrough, wherein said apertures collectively define an interior volume extending between an ion inlet and an ion outlet through which the ions can traverse. The apparatus also can comprise a controller configured to apply a DC electric potential to each of said electrodes without applying an RF potential to any of the electrodes, so as to exert a focusing force on ions passing through each of said apertures towards a central axis of said volume. One or more openings can be formed between the plurality of electrodes through which gas can escape said volume.

Related aspects of at least one embodiment of the applicant's teachings provide an apparatus, e.g., as described above, in which the plurality of electrodes are ring-shaped.

Related aspects of at least one embodiment of the applicant's teachings provide an apparatus, e.g., as described above, in which each of the electrodes is separated by a distance in the range of about 0.001 mm to about 1 mm from a neighboring electrode.

Related aspects of at least one embodiment of the applicant's teachings provide an apparatus, e.g., as described above, in which each of the electrodes has a thickness in the range of about 0.001 mm to about 1 mm.

Related aspects of at least one embodiment of the applicant's teachings provide an apparatus, e.g., as described above, in which the cross-sectional areas of the plurality of apertures decrease linearly from the ion inlet to the ion outlet, such that said volume has a frusto-conical shape.

Related aspects of at least one embodiment of the applicant's teachings provide an apparatus, e.g., as described above, in which the cross-sectional areas of the plurality of apertures decrease non-linearly from the ion inlet to the ion outlet, such that said volume has a curved frusto-conical shape.

Related aspects of at least one embodiment of the applicant's teachings provide an apparatus, e.g., as described above, in which the cross-sectional areas of the plurality of apertures are substantially identical, such that said volume has a cylindrical shape.

Related aspects of at least one embodiment of the applicant's teachings provide an apparatus, e.g., as described above, in which the controller applies a DC potential to each of the plurality of electrodes that is opposite in polarity to a DC potential applied to the immediately-preceding electrode, if any, in the ion inlet direction.

Related aspects of at least one embodiment of the applicant's teachings provide an apparatus, e.g., as described above, in which the controller applies a DC potential to each of the plurality of electrodes that is less than a DC potential applied to the immediately-preceding electrode, if any, in the ion inlet direction.

Related aspects of at least one embodiment of the applicant's teachings provide an apparatus, e.g., as described above, in which, if it is assumed that the plurality of electrodes are numbered with consecutive positive integers from the ion inlet to the ion outlet, then the controller applies a DC potential having a first polarity to odd-numbered electrodes and applies a DC potential having an opposite polarity to even-numbered electrodes.

Related aspects of at least one embodiment of the applicant's teachings provide an apparatus, e.g., as described above, in which the DC potential having the first polarity and the DC potential having the opposite polarity have the same magnitude.

Related aspects of at least one embodiment of the applicant's teachings provide an apparatus, e.g., as described above, in which the change in DC potential between two adjacent electrodes alternates between an increasing change and a decreasing change as the electrodes extend from the ion inlet to the ion outlet.

Related aspects of at least one embodiment of the applicant's teachings provide an apparatus, e.g., as described above, in which a plot of the DC potentials applied to the plurality of electrodes defines alternating peaks and troughs, the magnitudes of the peaks decreasing progressively from the ion inlet to the ion outlet and the magnitudes of the troughs decreasing progressively from the ion inlet to the ion outlet.

Related aspects of at least one embodiment of the applicant's teachings provide an apparatus, e.g., as described above, in which, if it is assumed that the plurality of electrodes are numbered with consecutive positive integers from the ion inlet to the ion outlet, then the controller applies a DC potential to each even-numbered electrode that is less than a DC potential applied to any preceding electrode in the ion inlet direction, and for each odd-numbered electrode for which an immediately-preceding even-numbered electrode and an immediately-preceding odd-numbered electrode exist in the ion inlet direction, the controller applies a DC potential to the odd-numbered electrode that is greater than a DC potential applied to the immediately-preceding even-numbered electrode and that is less than a DC potential applied to the immediately-preceding odd-numbered electrode.

Related aspects of at least one embodiment of the applicant's teachings provide an apparatus, e.g., as described above, that includes a plurality of support members extending through the plurality of electrodes and configured to maintain a spaced relationship and axial alignment between the plurality of electrodes.

Related aspects of at least one embodiment of the applicant's teachings provide an apparatus, e.g., as described above, in which the support members are coupled to an orifice plate of a mass spectrometer such that the ion outlet is aimed towards an orifice formed in the orifice plate.

In another aspect of at least one embodiment of the applicant's teachings, a method of focusing dispersed ions using a DC ion funnel is provided, where the ion funnel comprises a plurality of electrodes spaced apart from one another, each of said electrodes having an aperture for passage of ions therethrough, wherein said apertures collectively define an interior volume extending between an ion inlet and an ion outlet. The method includes directing a stream of ions into the ion inlet of the DC ion funnel and applying a DC potential to each of the plurality of electrodes without applying an RF potential to any of the electrodes, so as to focus the stream of ions towards a central axis of said volume as the ions move from the ion inlet to the ion outlet.

Related aspects of at least one embodiment of the applicant's teachings provide a method, e.g., as described above, that can comprise maintaining the pressure within the DC ion funnel at a value that is at least about 0.1 Torr.

Related aspects of at least one embodiment of the applicant's teachings provide a method, e.g., as described above, that can comprise allowing a carrier gas in which the stream of ions are initially dispersed to escape from the DC ion funnel through one or more openings formed between the plurality of electrodes.

Related aspects of at least one embodiment of the applicant's teachings provide a method, e.g., as described above, in which a DC potential is applied to each of the plurality of electrodes that is opposite in polarity to a DC potential applied to an immediately-preceding electrode, if any, in the ion inlet direction.

Related aspects of at least one embodiment of the applicant's teachings provide a method, e.g., as described above, in which, if it is assumed that the plurality of electrodes are numbered with consecutive positive integers from the ion inlet to the ion outlet, a DC potential having a first polarity is applied to odd-numbered electrodes and a DC potential having an opposite polarity is applied to even-numbered electrodes.

Related aspects of at least one embodiment of the applicant's teachings provide a method, e.g., as described above, in which the DC potential having the first polarity and the DC potential having the opposite polarity have the same magnitude.

Related aspects of at least one embodiment of the applicant's teachings provide a method, e.g., as described above, in which DC potentials are applied to the plurality of electrodes such that the change in DC potential between two adjacent electrodes alternates between an increasing change and a decreasing change as the electrodes extend from the ion inlet to the ion outlet.

Related aspects of at least one embodiment of the applicant's teachings provide a method, e.g., as described above, in which a plot of the DC potentials applied to the plurality of electrodes defines alternating peaks and troughs, the magnitudes of the peaks decreasing progressively from the ion inlet to the ion outlet and the magnitudes of the troughs decreasing progressively from the ion inlet to the ion outlet.

Related aspects of at least one embodiment of the applicant's teachings provide a method, e.g., as described above, in which, if it is assumed that the plurality of electrodes are numbered with consecutive positive integers from the ion inlet to the ion outlet, then a DC potential is applied to each even-numbered electrode that is less than a DC potential applied to any preceding electrodes in the ion inlet direction, and for each odd-numbered electrode for which an immediately-preceding even-numbered electrode and an immediately-preceding odd-numbered electrode exist in the ion inlet direction, a DC potential is applied to the odd-numbered electrode that is greater than a DC potential applied to the immediately-preceding even-numbered electrode and that is less than a DC potential applied to the immediately-preceding odd-numbered electrode.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DESCRIPTION OF VARIOUS EMBODIMENTS

Certain exemplary embodiments will now be described to provide an overall understanding of the principles of the structure, function, manufacture, and use of the methods, systems, and devices disclosed herein. One or more examples of these embodiments are illustrated in the accompanying drawings. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Systems and related methods are disclosed herein that generally involve focusing dispersed ions using one or more DC ion funnels. In some embodiments, a DC ion funnel is provided that includes a plurality of ring-shaped electrodes, each having an aperture formed therein such that the funnel defines an interior volume through which ions can traverse from an ion inlet to an ion outlet. The volume can have any of a variety of shapes, such as cylindrical, frusto-conical, and curved frusto-conical. A controller applies a DC potential to each of the electrodes without applying an RF potential to any of the electrodes, which can, in some embodiments, vary from one electrode to the next, either in polarity, in magnitude, or in both polarity and magnitude. These potentials can generate a substantially uniform DC field in the inner part of the funnel, while the DC field near the walls of the funnel can be highly inhomogeneous. As a result, ions that approach the interior walls of the funnel experience periodic field oscillations as they move through the funnel, which urge the ions towards the funnel's central axis where the DC field is substantially uniform. Dispersed ions entering the funnel inlet can thus be focused towards the funnel axis as they move towards the funnel outlet. The term "funnel" as used herein refers not only to structures having a traditional funnel-like shape, but also to those having any of a variety of other shapes (e.g., linear ion guides, non-linear ion guides, and so forth).

Figure 1:
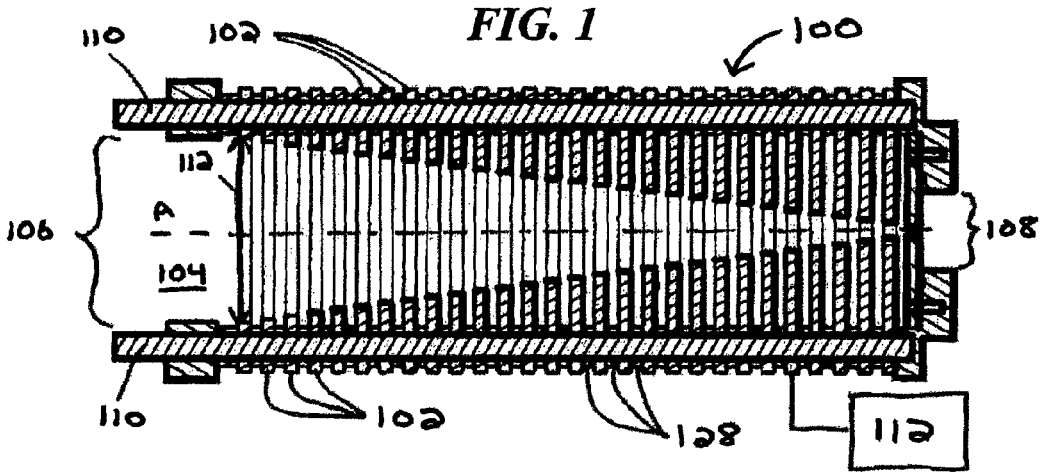
FIG. 1 is a schematic cross-sectional view of one exemplary embodiment of a DC ion funnel according to the applicant's teachings.

FIG. 1 is a schematic cross-sectional illustration of one exemplary embodiment of a DC ion funnel 100 according to the applicant's teachings. As shown, the funnel 100 can comprise a plurality of ring-shaped electrodes 102 that define an interior cavity or volume 104 extending between an ion inlet 106 and an ion outlet 108 through which ions can traverse from the ion inlet 106 to the ion outlet 108. The electrodes 102 are mounted to one or more supports 110, which maintain the electrodes 102 in a spaced relationship at a fixed distance apart from one another. In some embodiments, the supports 110 can be omitted and each electrode 102 can instead be glued or otherwise fastened to an intermediate insulating spacer, which can in turn be glued or fastened to the next adjacent electrode 102. In the illustrated embodiment, the distance between adjacent electrodes 102 is the same for each electrode, however in other cases the distances between adjacent electrodes 102 can vary.

In the illustrated embodiment, each of the electrodes 102 defines a central opening 112 that is axially aligned with the central openings of the other electrodes. This axial alignment can be maintained by the supports 110. In the illustrated embodiment, the central opening 112 of each electrode 102 has an inner diameter that is less than the inner diameter of the immediately-preceding electrode, such that the DC ion funnel 100 defines a substantially conical or frusto-conical interior cavity 104. It will be appreciated, however, that a variety of other configurations are possible, as discussed below.

The electrodes 102 can be formed from any of a variety of conductive materials, such as stainless steel, gold, copper, platinum, and so forth. The number of electrodes 102, the thickness of the electrodes, the spacing between the electrodes, the inner and outer diameters of the electrodes, and various other design parameters can be optimized depending on the particular application. In some embodiments, the DC ion funnel 100 can comprise ninety-eight electrodes 102. Each of the electrodes 102 can be separated by a distance of 0.1 mm, have a thickness of 0.1 mm, and an outer diameter of 50 mm. In the illustrated embodiment, the inner diameters of the electrodes 102 decrease progressively from a maximum of 10 mm for the electrode closest to the ion inlet 106 to a minimum of 1 mm for the electrode closest to the ion outlet 108. Assuming that the axial gas velocity at the ion outlet 108 is approximately the same as the axial gas velocity at the ion inlet 106, the ratio of the axial gas flows between the inlet and the outlet is approximately defined by the ratio of inlet area to the outlet area. For example, if the inlet 106 diameter is 10 mm and the outlet 108 diameter is 1 mm, only approximately 1% of the gas flow entering the DC ion funnel 100 is conducted towards the exit. This can provide substantial reduction of the gas flow rate entering the following stage of the mass spectrometer, while the ion current can be maintained at the same levels between the input and the output when the losses of ions are minimized due to DC funneling action.

The DC ion funnel 100 also can comprise a controller 112 configured to selectively apply a DC potential to one or more of the electrodes 102. For example, the controller 112 can comprise, or can be coupled to, one or more DC power sources and other control circuitry known in the art, such that the controller can selectively apply DC potentials to one or more of the electrodes 102. In some embodiments, the DC potential is applied to the one or more electrodes 102 without simultaneously applying an RF potential to any of the electrodes.

Figure 2A:
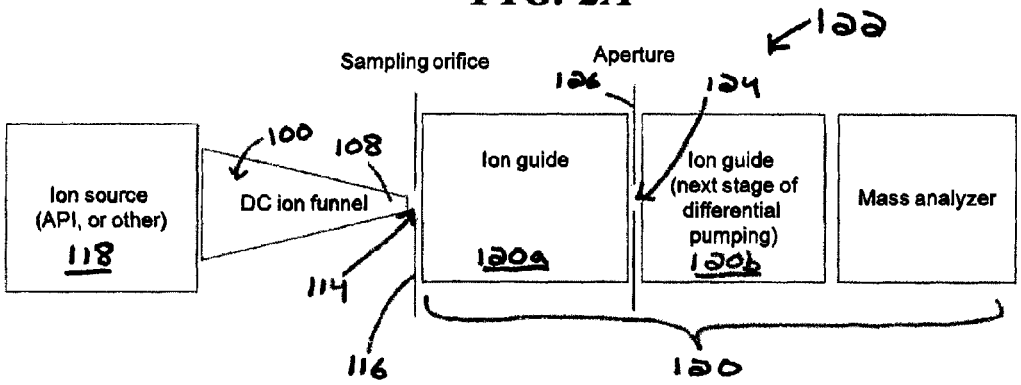
FIG. 2A is a schematic block diagram of one exemplary embodiment of a mass spectrometer that can comprise a DC ion funnel according to the applicant's teachings.
Figure 2B:
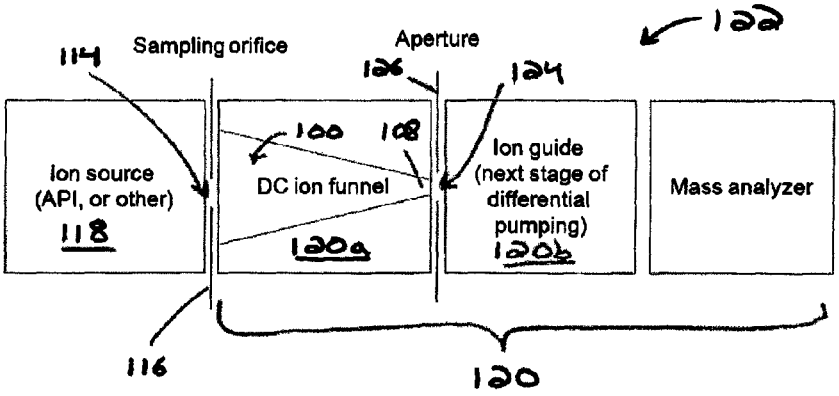
FIG. 2B is a schematic block diagram of another exemplary embodiment of a mass spectrometer that can comprise a DC ion funnel according to the applicant's teachings.

The DC ion funnel 100 can be mounted within a mass spectrometer such that the ion outlet 108 is in proximity to and aimed towards an opening formed in a plate that divides pressure regions of the mass spectrometer. For example, as shown in FIG. 2A, the DC ion funnel 100 can be positioned such that the ion outlet 108 is adjacent to a sampling orifice 114 formed in an orifice plate 116 that separates the ion source and analyzer modules 118, 120 of a mass spectrometer 122. Alternatively, as shown in FIG. 2B, the DC ion funnel 100 can be positioned such that the ion outlet 108 is adjacent to an aperture 124 formed in an aperture plate 126 that divides a first differential pumping stage 120*a* from a second differential pumping stage 120*b*. It will be appreciated that, in some embodiments, a plurality of DC ion funnels 100 can be used in a mass spectrometer system. For example, each differential pumping stage 120*a*, 120*b* can include its own DC ion funnel 100 such that ions are directed from the outlet 108 of a first funnel 100 to the inlet of a second, downstream funnel (not shown).

In operation, ions dispersed in a carrier gas are directed into the inlet 106 of the funnel 100 while the controller 112 applies a DC potential to each of the electrodes 102. The DC potential can vary from one electrode to the next, either in polarity, in magnitude, or in both polarity and magnitude. Alternatively, one or more of the electrodes can have the same DC potential. These potentials generate a substantially uniform DC field in the inner part of the funnel 100 near the funnel axis A. Near the walls of the funnel 100, however, the DC field can become highly inhomogeneous. As a result, ions that approach the interior walls of the funnel 100 can experience periodic field oscillations as they move through the funnel 100 from the ion inlet 106 to the ion outlet 108. In other words, in the ion's frame of reference, an oscillating field can be observed as the ion moves through the funnel 100 past the electrodes 102, even though the potential applied to the electrodes 102 comprises only a DC component.

These field oscillations experienced by the ions have on average a repulsive effect, urging the ions towards the central axis A of the funnel 100, where the DC field is substantially uniform. The dispersed ions thus move away from the wall of the funnel towards the funnel axis A as they move from the funnel inlet 106 towards the funnel outlet 108. The focusing effect can be influenced by the progressively decreasing diameter of the funnel interior 104, such that a focused beam of ions exits the funnel 100 through the ion outlet 108, where it can enter subsequent stages of a system in which the DC ion funnel 100 is installed (e.g., a mass spectrometer). The funnel 100 can comprise one or more openings along its length, in addition to the funnel inlet 106 and the funnel outlet 108. For example, in the illustrated embodiment, as the ions pass through the funnel 100, some or most of the carrier gas in which they are initially dispersed can escape from the funnel 100 through openings 128 formed between the electrodes 102.

In some embodiments, the frequency of oscillation experienced by ions passing through the funnel 100 can be increased by decreasing the spacing 128 between the electrodes 102, by decreasing the thickness of the electrodes 102, and/or by increasing the velocity of the carrier gas. Similarly, the frequency can be decreased by increasing the spacing 128 between the electrodes 102, by increasing the thickness of the electrodes 102, and/or by decreasing the velocity of the carrier gas. Increasing the frequency experienced by the ions permits the DC ion funnel 100 to operate effectively at higher operating pressures. By choosing particularly thin electrodes (e.g., electrodes having a thickness less than approximately 1 mm, e.g., in a range of about 0.001 mm to about 1 mm), the frequency of oscillations experienced by the ions can be made quite high (e.g., at least about 1 MHz, for example in the case of a 1 mm periodic spacing with a 1000 m/s axial velocity). Whereas decreased electrode thickness can provide significant benefits in the DC ion funnel 100, it should be noted that such reductions of the thickness of individual electrodes can be counterproductive in the prior art RF ion funnels, as thinner electrodes increase the load capacitance of such funnels and lead to impractically high RF power consumption.

Figure 3:
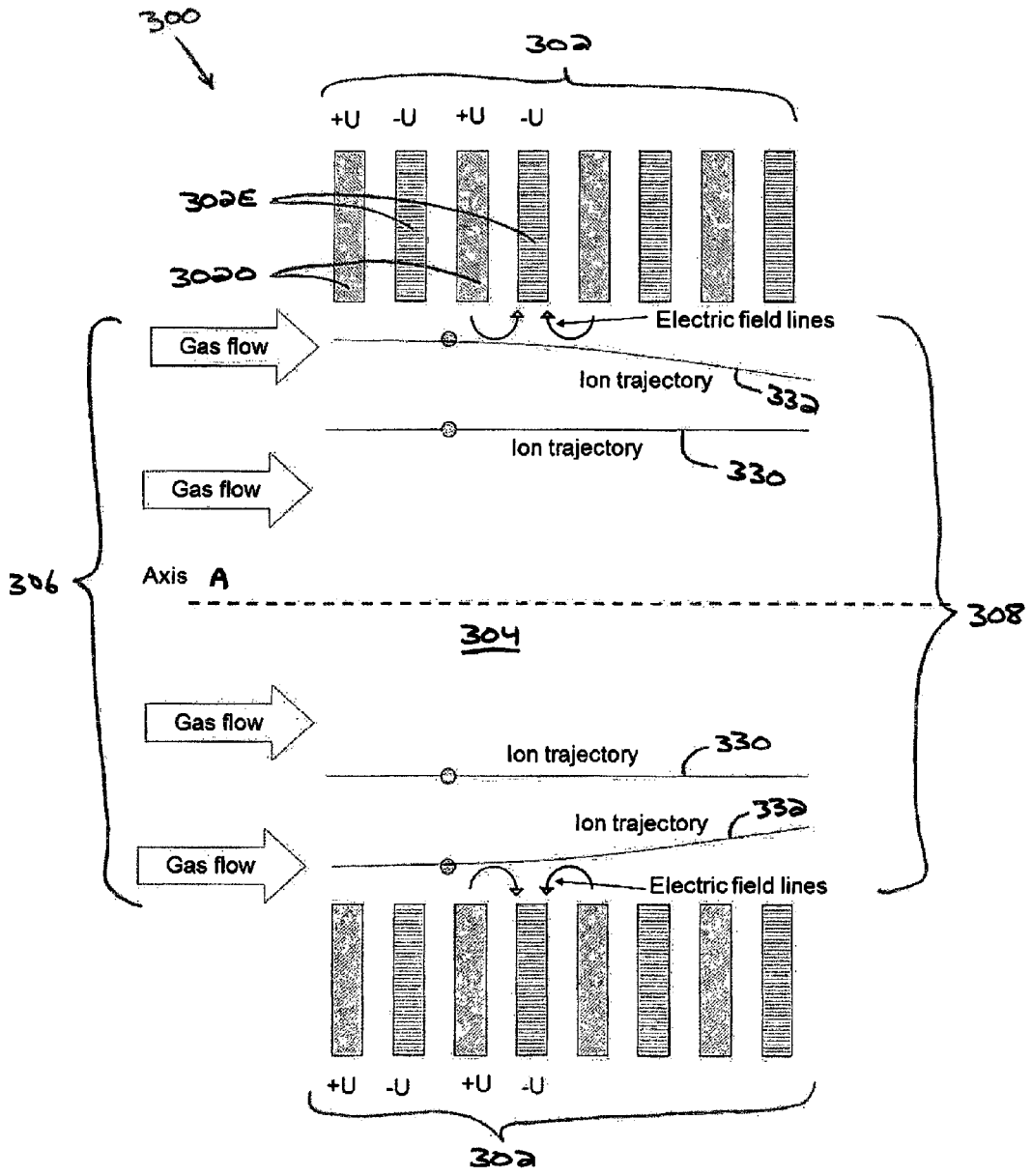
FIG. 3 is a schematic cross-sectional view of another exemplary embodiment of a DC ion funnel according to the applicant's teachings.

FIG. 3 is a schematic cross-sectional illustration of another exemplary embodiment of a DC ion funnel 300 according to the applicant's teachings. As shown, the DC ion funnel 300 can comprise a plurality of ring-shaped electrodes 302 spaced a distance apart from one another along an axis A that extends between an ion inlet 306 and an ion outlet 308. Each of the electrodes 302 includes an aperture that is centered about the axis A of the funnel 300. In the funnel 300 of FIG. 3, each of the ring-shaped electrodes 302 has a substantially identical aperture diameter such that the funnel 300 defines a cylindrical internal volume 304.

In operation, a controller (not shown) applies DC potentials to each electrode 302 that alternate in polarity such that a potential of +U is applied to each "odd-numbered" electrode 3020 and a potential of −U is applied to each "even-numbered" electrode 302E. Of course, the controller can also be configured to do the opposite, that is, to apply a potential of +U to each even-numbered electrode 302E and a potential of −U to each odd-numbered electrode 3020. In some embodiments, the magnitude of the potential U is between about 1V and about 1000V, and in some cases, between about 10V and about 300V. As an ion beam comprising a plurality of ions dispersed in a carrier gas is directed through the funnel 300, ions moving near the axis A of the funnel 300 experience a substantially uniform DC field and thus follow a substantially linear trajectory 330 through the funnel 300. On the other hand, ions moving near the periphery of the funnel 300 experience an oscillating field as they pass each oppositely charged electrode 302. These field oscillations experienced by the ion urge the ion along an arcuate trajectory 332, towards the central axis A of the funnel. In other words, the ion will be forced away from the walls of the funnel until it moves away by a distance of, for example, several steps of the periodic structure of the funnel, at which point the field experienced by the ion will become virtually uniform and the repelling force will diminish. As a result, ions passing through the funnel 300 are substantially confined to a volume proximate to the central axis A of the funnel 300, thereby allowing the ions to be focused on a target at the outlet 308 of the funnel 300 (e.g., a sampling orifice or aperture between pumping stages of a mass spectrometer). The funnel 300 of FIG. 3 thus forms a substantially straight tube for focusing ions.

Figure 4A:
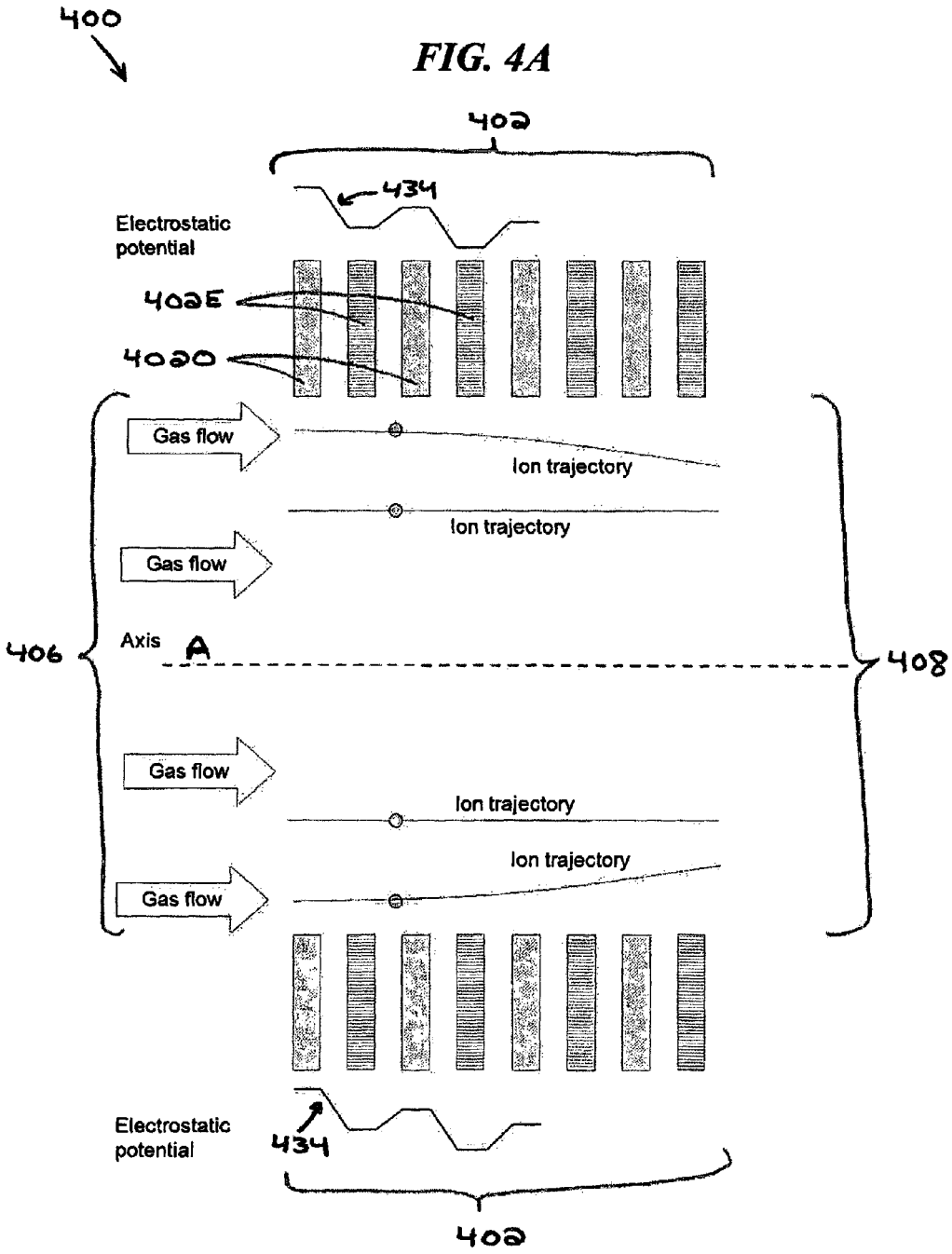
FIG. 4A is a schematic cross-sectional view of another exemplary embodiment of a DC ion funnel according to the applicant's teachings.

FIG. 4A is a schematic cross-sectional illustration of another exemplary embodiment of a DC ion funnel 400 according to the applicant's teachings. The structure and operation of the funnel 400 is substantially similar to that of the funnel 300 shown in FIG. 3, except with respect to the potentials applied to the electrodes 402 of the funnel 400. In the funnel 400 of FIG. 4, the electrostatic potential applied to each successive electrode 402 is based on the illustrated function 434.

In particular, in the illustrated embodiment, the controller (not shown) applies a DC potential to the even-numbered electrodes 402E that is less than a DC potential applied to the immediately-preceding odd-numbered electrode and that is less than a DC potential applied to the immediately-preceding even-numbered electrode. The DC potential applied to each even-numbered electrode 402E is less than the DC potential applied to any preceding electrode in the ion inlet direction. The controller also applies a DC potential to each odd-numbered electrode 4020 that is greater than a DC potential applied to the immediately-preceding even-numbered electrode and that is less than a DC potential applied to the immediately-preceding odd-numbered electrode. Thus, the change in DC potential from one electrode 402 to the next alternates between increasing and decreasing, such that a plot of the DC potentials applied to the electrodes 402 defines alternating peaks and troughs, with the magnitude of the peaks progressively decreasing along the length of the funnel 400 and the magnitude of the troughs progressively decreasing along the length of the funnel. Although the magnitudes of the peaks and the magnitudes of the troughs progressively decrease, the change in voltage between each peak and the next adjacent trough is substantially constant, as is the change in voltage between each trough and the next adjacent peak. This pattern of DC potentials guides ions away from the walls of the funnel 400, while also providing an additional axial field, which can augment or replace the gas flow in urging the ions axially through the funnel 400 from the funnel inlet 406 to the funnel outlet 408. In other words, with the DC ion funnel 400, in some embodiments there is no need to rely on the carrier gas flow to provide axial movement to the ions. As a result, the DC ion funnel 400 can be used in the absence of a carrier gas flow. For example, it can be utilized with no carrier gas, or with a carrier gas that is substantially stagnant, which can also be called a buffer gas.

Figure 4B:
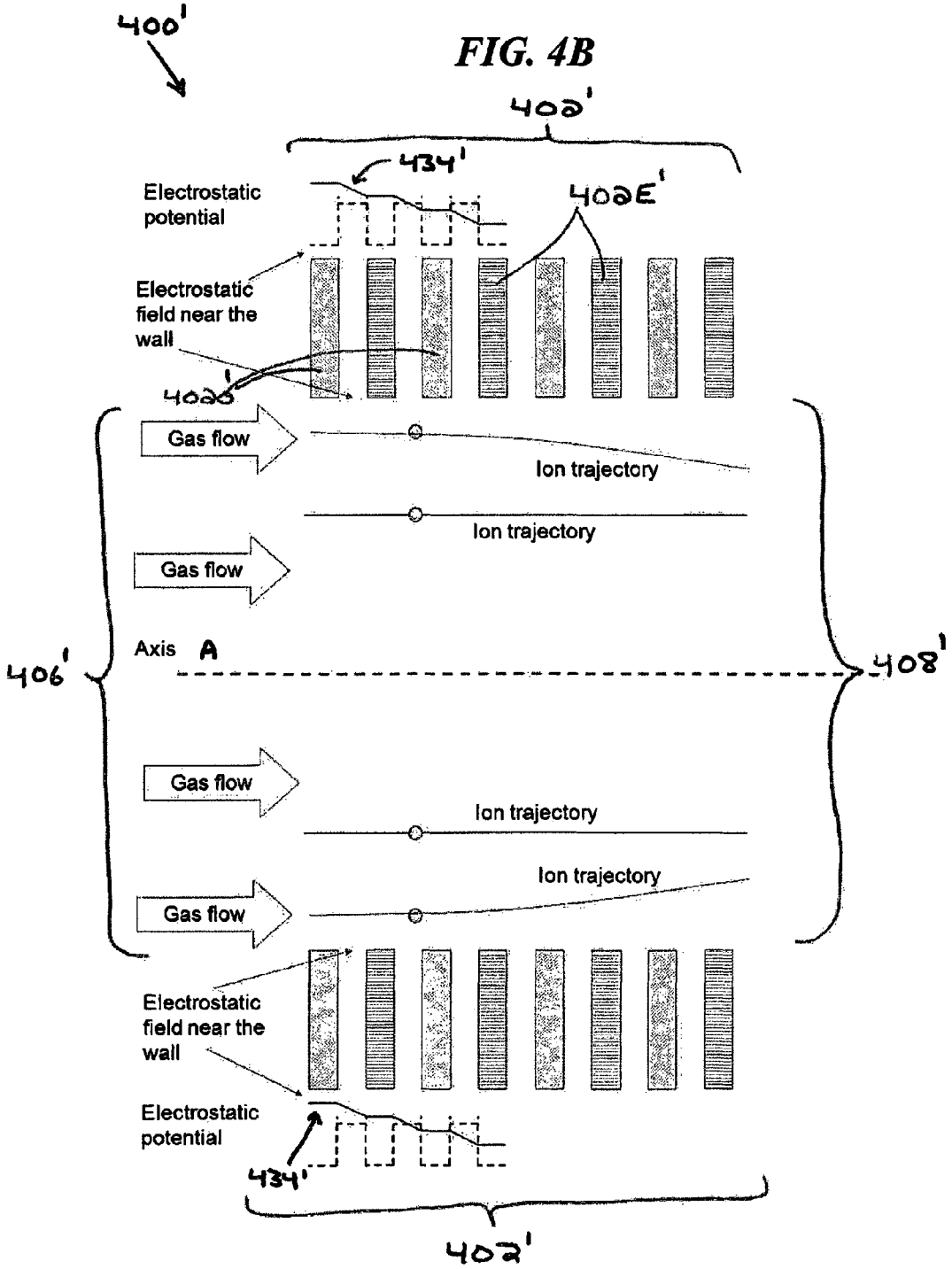
FIG. 4B is a schematic cross-sectional view of another exemplary embodiment of a DC ion funnel according to the applicant's teachings.

FIG. 4B is a schematic cross-sectional illustration of another exemplary embodiment of a DC ion funnel 400' according to the applicant's teachings. The structure and operation of the funnel 400' is substantially similar to that of the funnel 400 shown in FIG. 4A, except with respect to the potentials applied to the electrodes 402' of the funnel 400'. In the funnel 400' of FIG. 4B, the electrostatic potential applied to each successive electrode 402' is based on the illustrated function 434'.

In particular, in the illustrated embodiment, the controller (not shown) applies a DC potential to each electrode 402' that is less than a DC potential applied to the immediately-preceding electrode. The controller applies a DC potential to each odd-numbered electrode 4020' that is less than a DC potential applied to the immediately-preceding odd-numbered electrode. The DC potentials in the illustrated embodiment decrease by approximately the same amount between each adjacent electrode. This pattern of DC potentials guides ions away from the walls of the funnel 400' while also providing an additional axial field, as in the funnel 400 of FIG. 4A. As indicated by the dotted lines in FIG. 4B, the electric field near the walls of the funnel 400' can oscillate between a field of approximately zero along the surface of the electrodes 402' and a non-zero field along the spaces between the electrodes. Thus, ions moving near the wall can experience periodic variations in electric field as they move towards the funnel outlet 408' from the inlet 406', driving them away from the wall.

Figure 5:
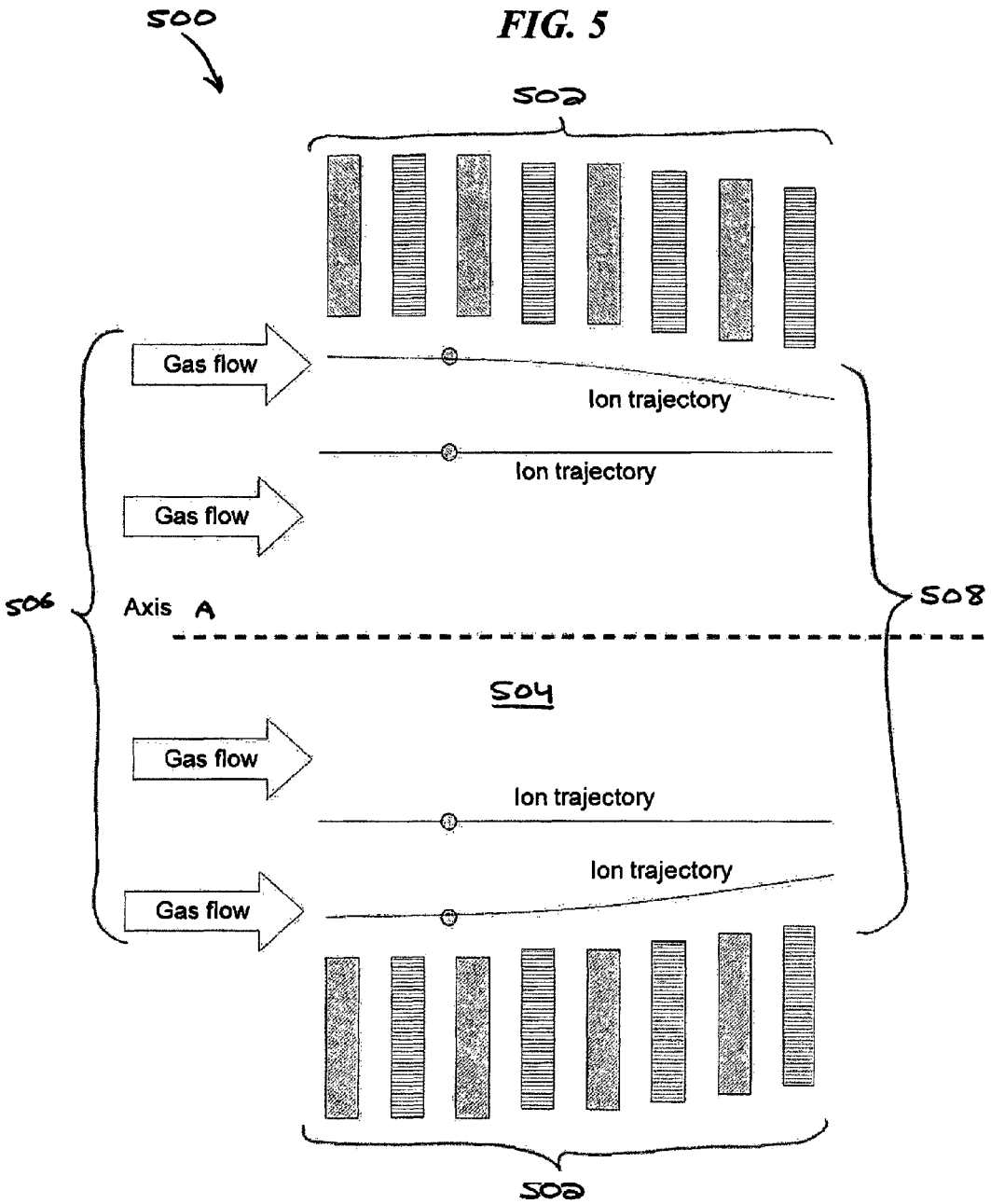
FIG. 5 is a schematic cross-sectional view of another exemplary embodiment of a DC ion funnel according to the applicant's teachings.

FIG. 5 is a schematic cross-sectional illustration of another exemplary embodiment of a DC ion funnel 500 according to the applicant's teachings, in which the inner diameters of the apertures formed in the electrodes 502 decrease progressively from the ion inlet 506 to the ion outlet 508. The curved walls of the cavity 504 defined by the funnel 500 provide a more pronounced focusing effect for ions passing therethrough. The controller (not shown) can apply any of the DC potential patterns described above to the electrodes 502, such as the alternating polarity pattern of FIG. 3, or the pattern of FIG. 4. Any of a variety of other DC potential patterns can also be employed.

Figure 6A:
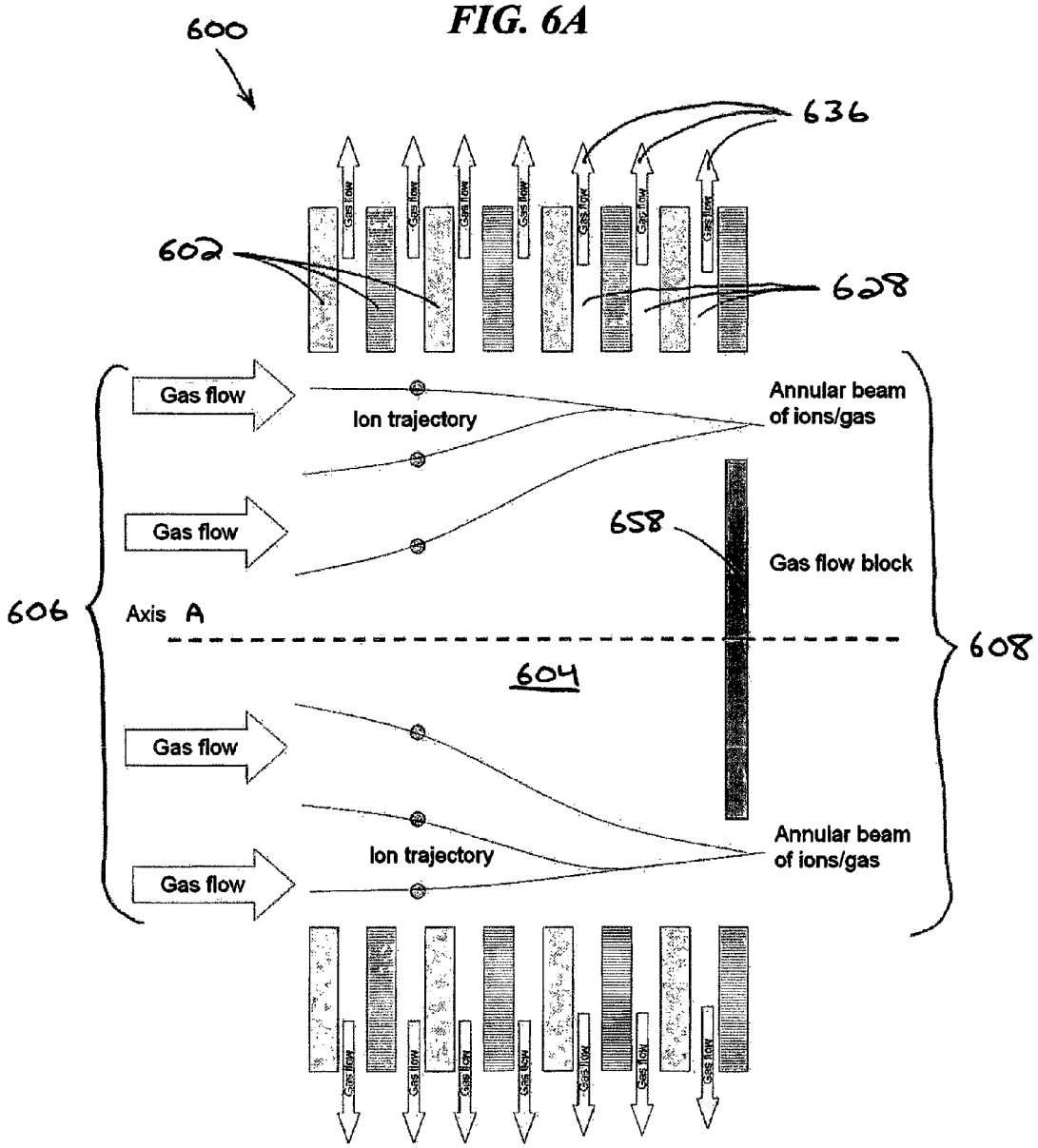
FIG. 6A is a schematic cross-sectional view of another exemplary embodiment of a DC ion funnel according to the applicant's teachings.

As shown in FIG. 6A, a DC ion funnel 600 according to the applicant's teachings can optionally comprise openings 628 in the spaces between the electrodes 602 to permit some or all of the carrier gas 636 to escape from the interior cavity 604 of the DC ion funnel 600. At the same time, ions dispersed in the gas can be substantially confined within the DC ion funnel 600. In some embodiments, this can increase the ratio of sample ions to carrier gas, which can advantageously permit sampling a greater flow of gas into the DC ion funnel section and passing the flow into the next section of a mass analyzer that has a lower gas flow handling capacity. In some embodiments, the escaped carrier gas 636 can be captured and recirculated through the system for subsequent use. In the embodiment of FIG. 6A, each of the ring-shaped electrodes 602 has a substantially identical aperture diameter such that the funnel 600 defines a cylindrical internal volume 604. In operation, ions entrained in the gas flow in the middle of the funnel 600 are brought to the region near the walls of the funnel 600 due to the effect of the gas flow escaping through the openings 628 between the electrodes 602. As a result, the ions moving from the inlet 606 to the outlet 608 form annular beam(s) that can be processed by the next stage of the mass spectrometer. In some embodiments, a solid gas-blocking electrode 658 can be placed in the middle of the funnel volume 604 to prevent carrier gas from flowing into the next chamber of the mass spectrometer.

Figure 6B:
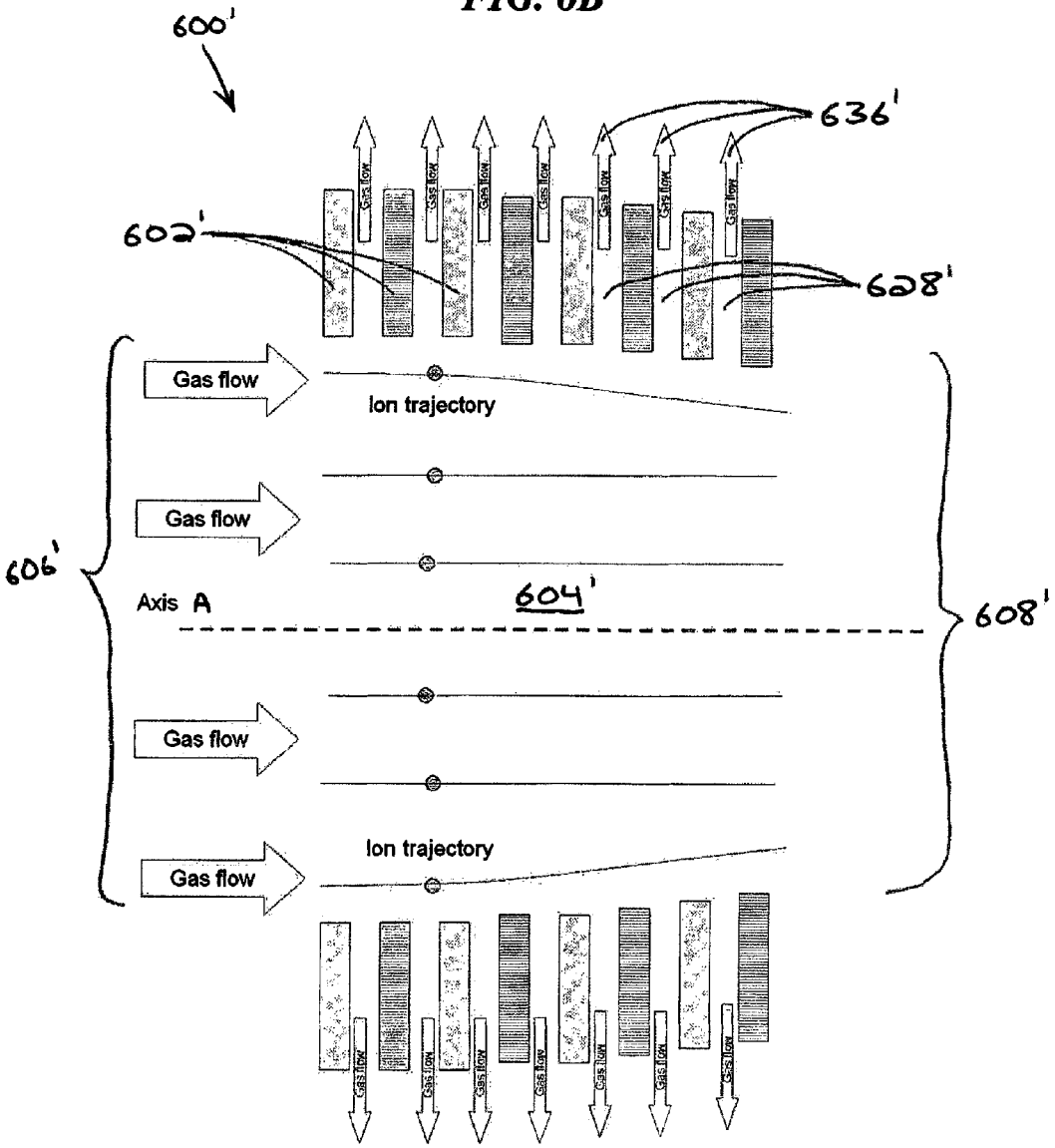
FIG. 6B is a schematic cross-sectional view of another exemplary embodiment of a DC ion funnel according to the applicant's teachings.

FIG. 6B is a schematic cross-sectional illustration of another exemplary embodiment of a DC ion funnel 600' according to the applicant's teachings, in which the inner diameters of the apertures formed in the electrodes 602' decrease progressively from the ion inlet 606' to the ion outlet 608'. Such embodiments can also include openings 628' in the spaces between the electrodes 602' to permit some or all of the carrier gas 636' to escape from the interior cavity 604' of the DC ion funnel 600'. In some embodiments, the conical shape of the funnel 600' can continue until the streams of ions from opposite sides of the funnel merge. This can allow reduction of carrier gas flow into the following section of the mass spectrometer to occur naturally due to the reduction in the cross-sectional area of the funnel 600'. In other words, the geometry of the funnel 600' can be selected such that the flow of carrier gas exiting the funnel will be balanced by the reduction of the cross-sectional area. As a result, the ions in the middle of the funnel can remain on a straight path until the walls of the funnel come close to the ion trajectory and, after that, the trajectory can start bending towards the longitudinal axis A. If the flow is not properly balanced by the funnel geometry, ion trajectories in the core can bend towards the walls (e.g., as shown in FIG. 6A) or towards the axis. In any case, the ions can be prevented from escaping through the walls of the funnel by the oscillating electric field experienced in the ions' frame of reference. It will be appreciated that a gas-blocking electrode (not shown) can also be used in the funnel 600' (e.g., as described above with respect to FIG. 6A).

Figure 7A:
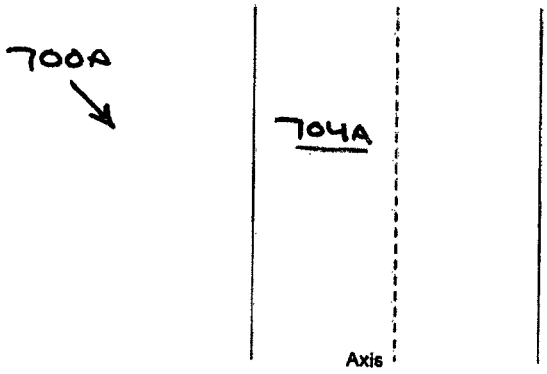
FIG. 7A is a schematic cross-sectional view of a DC ion funnel according to the applicant's teachings having a cylindrical volume through which ions can traverse from an ion inlet to an ion outlet.
Figure 7B:
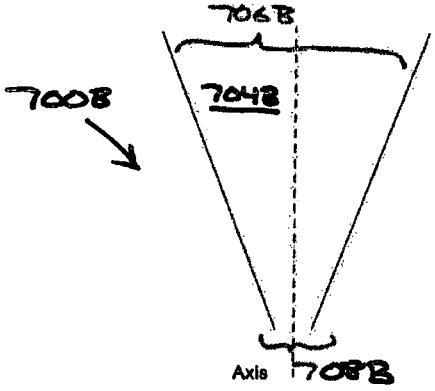
FIG. 7B is a schematic cross-sectional view of a DC ion funnel according to the applicant's teachings having a frusto-conical volume through which ions can traverse from an ion inlet to an ion outlet.
Figure 7C:
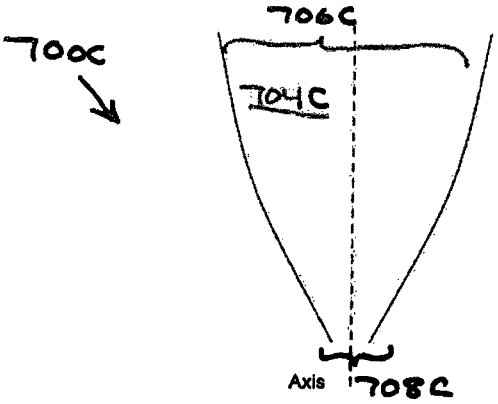
FIG. 7C is a schematic cross-sectional view of a DC ion funnel according to the applicant's teachings having a curved frusto-conical volume through which ions can traverse from an ion inlet to an ion outlet.

As shown in FIGS. 7A-7C, the inner volume defined collectively by the electrodes of the funnels disclosed herein can have a variety of cross-sectional shapes. In some embodiments, shown in FIG. 7A, an ion funnel 700A has a linear or rectangular cross-section such that the volume 704A is substantially cylindrical. In other embodiments, shown in FIG. 7B, an ion funnel 700B has a linearly-tapered, frusto-conical cross-section such that the volume 704B is substantially frusto-conical. In other words, the aperture diameter of each successive electrode ring decreases linearly from the ion inlet 706B to the ion outlet 708B. In yet other embodiments, shown in FIG. 7C, an ion funnel 700C has a cross-section defined by a non-linear taper or curved cone such that funnel 700C defines a curved frusto-conical volume 704C. In other words, the aperture diameter of each successive electrode ring decreases non-linearly from the ion inlet 706C to the ion outlet 708C. In some embodiments, the funnel need not necessarily define a volume having a linear central pathway. For example, the funnel can instead have a "stretched S" shaped interior volume, such that a winding lane is defined by the funnel walls.

Figure 8A:
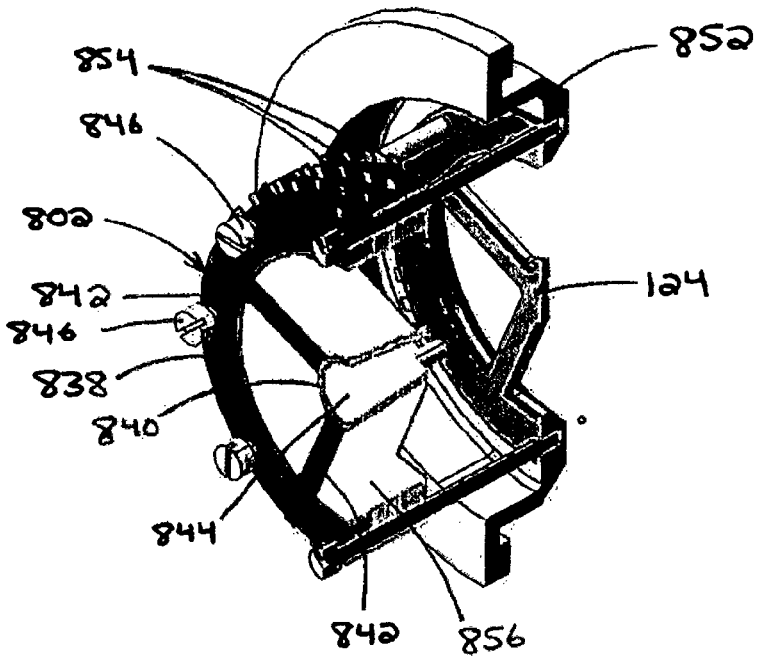
FIG. 8A is a perspective cross-sectional view of a DC ion funnel according to the applicant's teachings mounted to an aperture plate using a plurality of supports.
Figure 8B:
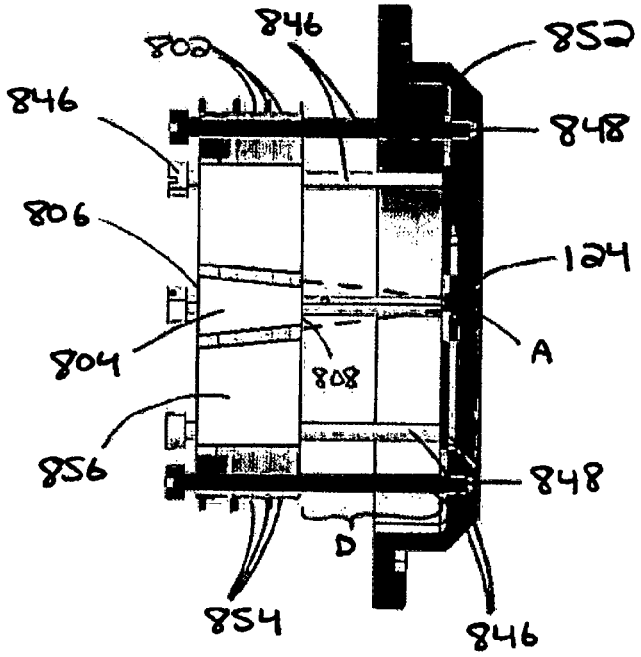
FIG. 8B is a side cross-sectional view of the DC ion funnel and aperture plate of FIG. 8A.

FIGS. 8A-8B illustrate another exemplary embodiment of a DC ion funnel 800 according to the applicant's teachings. As shown, the partially assembled funnel 800 is mounted to a support structure 852 of a mass spectrometer, such that the funnel 800 guides an ion beam directed therethrough towards an outlet aperture 124 of an aperture plate 126.

The funnel 800 includes a plurality of ring-shaped electrode plates 802 spaced a distance apart from one another. Each of the electrode plates 802 includes an outer ring 838, an inner ring 840, and a plurality of spokes 842 extending therebetween. The inner ring 840 of each electrode plate 802 can comprise an aperture 844, which defines a first volume 804 through the funnel 800 that extends from an ion inlet 806 to an ion outlet 808. A second volume 856 is formed in the space between the outer rings 838 and the inner rings 840. In the illustrated embodiment, the outer rings 838 of the electrode plates 802 have constant inner and outer diameters, while the inner and outer diameters of the inner rings 840 decrease progressively from the ion inlet 806 to the ion outlet 808. The inner electrode rings 840 are axially aligned with one another such that the apertures 844 formed therein collectively provide a frusto-conical cavity 804 within the funnel 800.

The slope of this frusto-conical cavity 804 and the separation D between the funnel 800 and the orifice plate 116 can be selected such that the apex A of a cone defined in part by the cavity 804 lies on the outlet aperture 124, in the plane of the aperture plate 126. In other words, the funnel 800 can be "aimed" at the outlet aperture 124 to maximize the proportion of ions that successfully pass through the outlet aperture 124.

A plurality of support posts 846 extend through the outer rings 838 of the electrode plates 802 and maintain the funnel 800 at a fixed distance D from the aperture plate 126. Each support post 846 can comprise a threaded exterior surface configured to engage a corresponding threaded recess 848 formed in the support structure 852. The support posts 846 can be tightened to compress the outer rings 838 of the electrode plates 802 against insulating rings 854 disposed therebetween. This can provide the funnel 800 with a substantially-sealed external wall, isolating the first and second volumes 804, 856 from atmospheric pressure. Carrier gas that escapes from the first volume 804 into the second volume 856 through spaces between the inner rings 840 can be removed from the funnel 800 by a roughing pump (not shown).

In operation, a dispersed ion beam can be directed into the inlet 806 of the funnel 800 while a controller (not shown) applies a DC potential to each of the electrode plates 802 according to any of the patterns described above. Ions passing through the funnel 800 are focused by the funnel 800 on the outlet aperture 124 such that an increased proportion of ions pass through the outlet aperture 124 for subsequent analysis.

The DC ion funnels disclosed herein can advantageously permit a beam of dispersed ions to be focused under relatively high pressures. Thus, in some embodiments, the pressure within such funnels can be maintained at a value of at least about 0.1 Torr. For example, the pressure in the funnel can be between about 1 Torr and about 100 Torr.

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. An apparatus for focusing dispersed ions, comprising:

a plurality of electrodes spaced apart from one another, each of said electrodes having the same thickness and having an aperture for passage of ions therethrough, wherein said apertures collectively define an interior volume extending between an ion inlet and an ion outlet through which the ions can traverse; and a controller configured to apply a DC electric potential to each of said electrodes without applying an RF potential to any of the electrodes, so as to exert a focusing force on ions passing through each of said apertures towards a central axis of said volume;

wherein one or more openings are formed between the plurality of electrodes through which gas can escape said volume;

wherein the controller applies a DC potential to each of the plurality of electrodes that is opposite in polarity to a DC potential applied to the immediately-preceding electrode, if any, in the ion inlet direction; and wherein the change in DC potential between two adjacent electrodes alternates between an increasing change and a decreasing change as the electrodes extend from the ion inlet to the ion outlet and wherein, if it is assumed that the plurality of electrodes are numbered with consecutive positive integers from the ion inlet to the ion outlet, then:

the controller applies a DC potential to each even-numbered electrode that is less than a DC potential applied to any preceding electrodes in the ion inlet direction; and for each odd-numbered electrode for which an immediately-preceding even-numbered electrode and an immediately-preceding odd-numbered electrode exist in the ion inlet direction, the controller applies a DC potential to the odd-numbered electrode that is greater than a DC potential applied to the immediately-preceding even-numbered electrode and that is less than a DC potential applied to the immediately-preceding odd-numbered electrode.

2. The apparatus of claim 1, wherein the plurality of electrodes are ring-shaped.

3. The apparatus of claim 1, wherein the cross-sectional areas of the plurality of apertures decrease linearly from the ion inlet to the ion outlet, such that said volume has a frusto-conical shape.

4. The apparatus of claim 1, wherein the cross-sectional areas of the plurality of apertures decrease non-linearly from the ion inlet to the ion outlet, such that said volume has a curved frusto-conical shape.

5. The apparatus of claim 1, further comprising a plurality of support members extending through the plurality of electrodes and configured to maintain a spaced relationship and axial alignment between the plurality of electrodes.

6. The apparatus of claim 5, wherein the support members are coupled to an orifice plate of a mass spectrometer such that the ion outlet is aimed towards an orifice formed in the orifice plate.

7. A method of focusing dispersed ions using a DC ion funnel comprising a plurality of electrodes spaced apart from one another, each of said electrodes having the same thickness and having an aperture for passage of ions therethrough, wherein said apertures collectively define an interior volume extending between an ion inlet and an ion outlet, the method comprising:

directing a stream of ions into the ion inlet of the DC ion funnel; and applying a DC potential to each of the plurality of electrodes without applying an RF potential to any of the electrodes, so as to focus the stream of ions towards a central axis of said volume as the ions move from the ion inlet to the ion outlet;

and wherein a DC potential is applied to each of the plurality of electrodes that is opposite in polarity to a DC potential applied to an immediately-preceding electrode, if any, in the ion inlet direction; and wherein DC potentials are applied to the plurality of electrodes such that the change in DC potential between two adjacent electrodes alternates between an increasing change and a decreasing change as the electrodes extend from the ion inlet to the ion outlet and wherein if it is assumed that the plurality of electrodes are numbered with consecutive positive integers from the ion inlet to the ion outlet;

a DC potential is applied to each even-numbered electrode that is less than a DC potential applied to any preceding electrodes in the ion inlet direction; and for each odd-numbered electrode for which an immediately-preceding even-numbered electrode and an immediately-preceding odd-numbered electrode exist in the ion inlet direction, a DC potential is applied to the odd-numbered electrode that is greater than a DC potential applied to the immediately-preceding even-numbered electrode and that is less than a DC potential applied to the immediately-preceding odd-numbered electrode.

* * * * *